United States Patent [19]

Masuda et al.

[11] Patent Number: 5,031,586

[45] Date of Patent: Jul. 16, 1991

[54] MULTI-VALVE ENGINE

[75] Inventors: Shunji Masuda; Noriyuki Iwata; Osamu Sado; Kazuhiko Hashimoto; Tatsuya Uesugi, all of Hiroshima, Japan

[73] Assignee: Mazda Motor Corporation, Japan

[21] Appl. No.: 588,390

[22] Filed: Sep. 26, 1990

[30] Foreign Application Priority Data

Sep. 28, 1989 [JP] Japan ..... 1-255994
Sep. 28, 1989 [JP] Japan ..... 1-255995
Sep. 28, 1989 [JP] Japan ..... 1-256005

[51] Int. Cl.[5] ..... F01L 1/26

[52] U.S. Cl. ..... 123/90.27; 123/90.35; 123/196 M; 123/432

[58] Field of Search ..... 123/90.22, 90.23, 90.27, 123/90.35, 196 M, 308, 432

[56] References Cited

U.S. PATENT DOCUMENTS 4,617,881 10/1986 Aoi et al. ..... 123/90.27
4,617,896 10/1986 Yoshikawa ..... 123/432
4,621,597 11/1986 Kawada et al. ..... 123/90.27
4,624,222 11/1986 Yoshikawa ..... 123/90.27
4,637,356 1/1987 Kuroda ..... 123/90.27
4,709,667 12/1987 Ichihara et al. ..... 123/90.27
4,766,866 8/1988 Takii et al. ..... 123/90.23

FOREIGN PATENT DOCUMENTS 0186009 11/1982 Japan ..... 123/90.27
0231121 12/1984 Japan ..... 123/90.27

*Primary Examiner*—David A. Okonsky
*Assistant Examiner*—Weilun Lo
*Attorney, Agent, or Firm*—Thompson, Hine and Flory

[57] ABSTRACT

A multi-valve engine of the type having a line of cylinders, intake and exhaust camshafts, and rocker arms for operatively connecting valves to the camshafts includes a first valve group of three valves consisting of either intake valves or exhaust valves and a second valve group consisting of the other of either intake valves or exhaust valves. Each of the valves of the first valve group is oriented such that a valve stem thereof is inclined outwardly to one side of the line of cylinders, while each of the valve of the second valve group is oriented such that a valve stem thereof inclines outwardly to an opposite side of the line of cylinders. First hydraulic lash adjuster means for a centrally-located valve out of three valves of the first valve group is positioned closer to a bore center of the cylinder than the centrally-located valve, or on a delay side in the rotational direction of the camshaft. Second and third hydraulic lash adjuster means for side-located valves of the three valves of the first valve group are positioned farther from the bore center than the side-located valves, or on a leading side in the rotational direction of the camshaft.

20 Claims, 8 Drawing Sheets

MULTI-VALVE ENGINE

BACKGROUND OF THE INVENTION

The present invention relates to a multi-valve engine having three valves consisting of either intake valves or exhaust valves.

As disclosed in Japanese Patent Application Laying-open Gazette No. 62-78453, a conventional multi-valve engine is generally provided with a set of three intake valves and two exhaust valves on each cylinder for the purpose of obtaining higher intake and exhaust efficiency.

In this type of engine, the three intake valves are oriented such that valve stems thereof are inclined outwardly to one side of a cylinder bore and are parallel to each other, while the two exhaust valves are oriented such that valve stems thereof are inclined outwardly to an opposite side of the cylinder bore. Lower surfaces of valve heads of the intake and exhaust valves are disposed into an angular shape so as to form a pent-roof type efficient combustion chamber.

The intake valves are driven by an intake camshaft through rocker arms and the exhaust valves are actuated by an exhaust camshaft through rocker arms. In detail, intake and exhaust rocker arm shafts are arranged in the cylinder line direction in farther positions from a center of the cylinder bore than the intake and exhaust valves. One end of each rocker arm is swingably supported by the rocker arm shaft, and the other end thereof is disposed on an end portion of a front shaft of the intake and the exhaust valves. A cam of the camshaft disposed on an upper side of the rocker arm makes contact with the central part of the rocker arm. Accordingly, the rocker arm swings along with the rotation of the camshaft, thus initiating vertical motion of the intake and exhaust valves.

In order to actuate the intake and the exhaust valves under a condition free from a valve lash, the inventors came up with the idea of using a different type of rocker arm from the conventional rocker arm in the above-mentioned multi-valve engine. They provided a rocker arm in such a way that one end thereof is supported on a supporting portion of hydraulic lash adjuster means and the other end thereof is mounted respectively on the end portions of the valve stems of the intake and the exhaust valves. The mechanism adopted is that the cam of the camshaft on the upper side of the rocker arm makes contact, from the upper direction, with substantially the center of the rocker arm to swing the rocker arm on the supporting portion of the hydraulic lash adjuster means as its axis along with the rotation of the camshaft, and thereby initiating the vertical motion of the intake and the exhaust valves.

However, the disadvantage of this mechanism is that since the three intake valves are arranged on one side of the cylinder bore at each cylinder, the size of the engine becomes substantially larger if any modification in the layout of the rocker arm and the hydraulic lash adjuster means is not undertaken. If the engine becomes larger, the original object of improving the intake and exhaust efficiency and combustion efficiency cannot be achieved.

Generally, the hydraulic lash adjuster means comprises a cylindrical casing having a bottom thereof, an inner sleeve attached slidably inside the casing. In this hydraulic lash adjuster means, a supporting portion including a pivot for supporting the rocker arm is further provided on a head portion of the inner sleeve. Then, a high hydraulic pressure is introduced to a hydraulic chamber formed between the casing and the inner sleeve to push the inner sleeve out of the casing. Thus, a force acting between the rocker arm and the supporting portion, namely, the supporting force, can be kept at a higher level. Consequently, a clearance between the rocker arm and the camshaft, and a clearance between the rocker arm and the intake and the exhaust valve become zero.

In the above-structured hydraulic lash adjuster means, the inner sleeve repeats a reciprocating motion in the casing. Accordingly, when given a force intersecting with the reciprocating motion thereof, i.e. a lateral force, by the supporting force, the inner sleeve vibrates due to its pivotal swing movement during the reciprocating motion thereof. As a result, a sliding contact surface of the inner sleeve is subject to an excessive wear, causing troubles like an oil leak from the hydraulic chamber. This will result in lower durability and reliability of the hydraulic lash adjuster means.

SUMMARY OF THE INVENTION

The present invention is directed to a multi-valve engine having a line of cylinders, intake and exhaust camshafts, and rocker arms for operatively connecting valves to the camshafts, comprising: a first valve group having a centrally-located valve and two side-located valves consisting of either intake valves actuated by the intake camshaft through the rocker arms, or exhaust valves actuated by the exhaust camshaft through the rocker arms; and a second valve group consisting of the other of either intake valves or exhaust valves. An object of the present invention is to provide the above-mentioned multi-valve engine with a compact and ideally-shaped pent-roof type combustion chamber while preventing a lateral force from acting upon the hydraulic lash adjuster means.

To achieve the above-mentioned object, the first invention has the following construction. Each of the valves of the first valve group is oriented such that a valve stem thereof is inclined outwardly to one side of the line of cylinders. Each of the valves of the second valve group is oriented such that a valve stem thereof is inclined outwardly to an opposite side of the line of cylinders. First hydraulic lash adjuster means for supporting a first one of the rocker arms actuating the centrally-located valve is positioned closer to a bore center of an associated one of the cylinders than the centrally-located valve so as to be inclined parallel to a direction of the supporting force for the first rocker arm. Second and third hydraulic lash adjuster means for supporting second and third ones of the rocker arms actuating the side-located valves are positioned farther from the bore center than the side-located valves.

The second invention has the following construction. The centrally-located valve and the side-located valves comprising the first valve group are biased away from each other in a direction forming a right angle with the cylinder line direction. The first hydraulic lash adjuster means for supporting the first one of the rocker arms actuating the centrally-located valve is on a delay side of the centrally-located valve in the rotational direction of the camshaft for driving the first valve group. The second and third hydraulic lash adjuster means for supporting the second and third ones of the rocker arms actuating the side-located valves are on a leading side of the side-located valves in the rotational direction of the camshaft for driving the first valve group.

BRIEF DESCRIPTION OF THE DRAWINGS

FIGS. 1 through 8 show a multi-valve engine in accordance with the present invention, illustrating preferred embodiments thereof, in which:

FIG. 1 is a sectional view taken on line I—I of FIG. 4;

FIG. 2 is a sectional view taken on line II—II of FIG. 4;

FIG. 3 is a sectional view taken on line III—III of FIG. 4;

FIG. 4 is a perspective plan view showing a periphery portion of a cylinder;

FIG. 5 is an enlarged side view in vertical section showing hydraulic lash adjuster means;

FIG. 6 is a sectional view, putting together a sectional view taken on line I—I of FIG. 7 and a sectional view taken on line I—I of FIG. 8;

FIG. 7 is a top view showing a cylinder head;

FIG. 8 is a top view showing a cam housing;

DETAILED DESCRIPTION OF THE INVENTION

Figure 1:
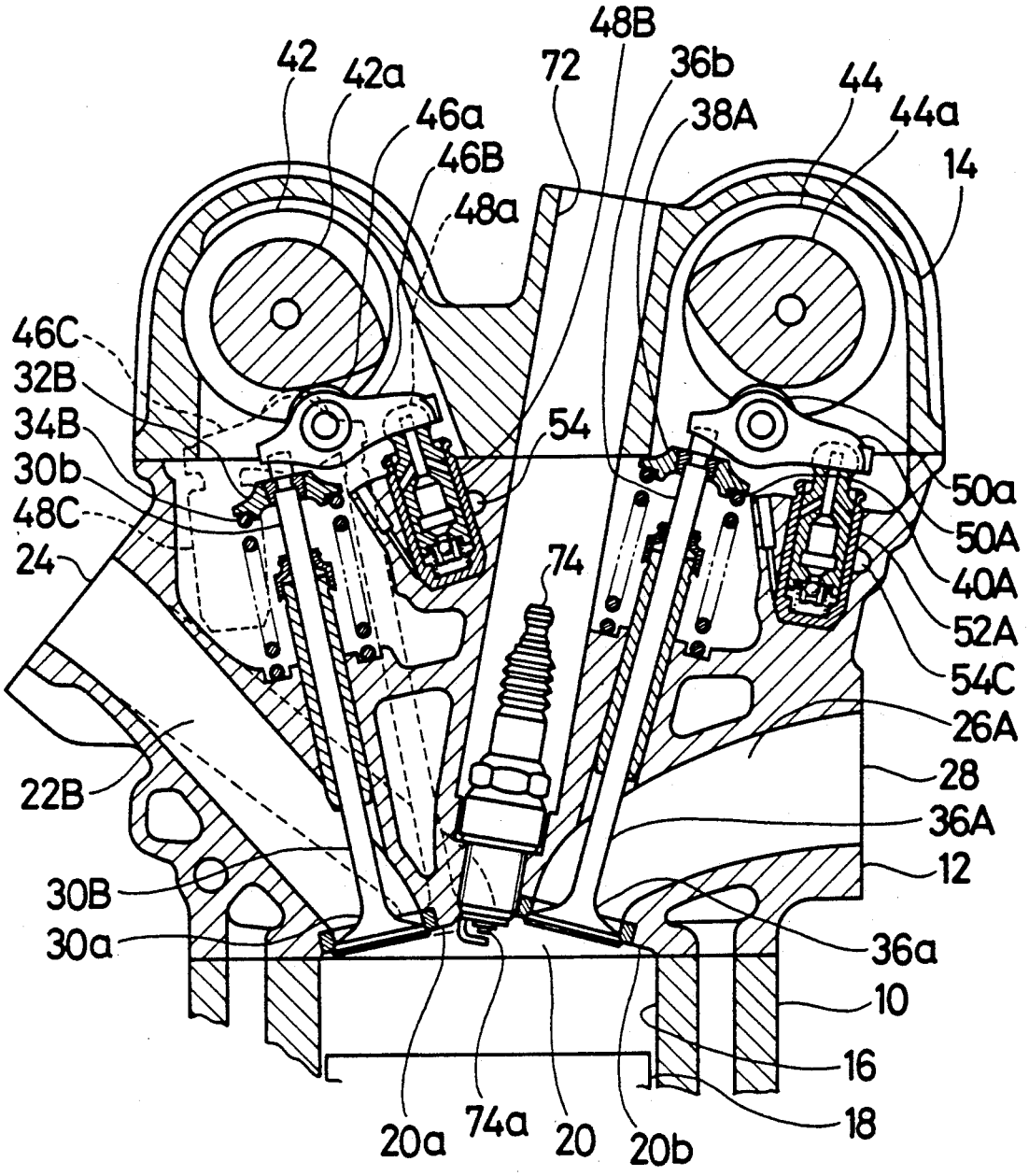
Figure 2:
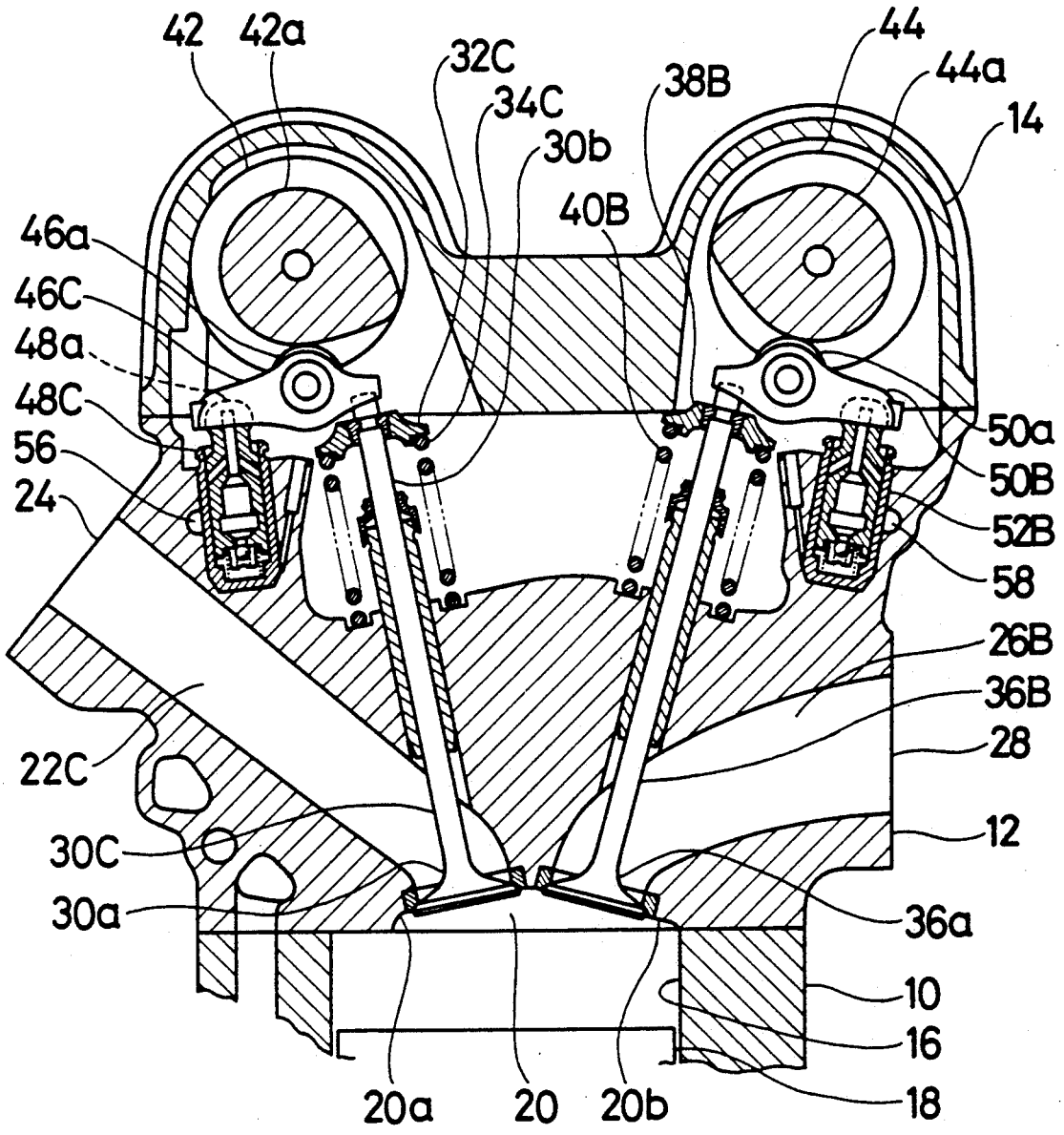
Figure 3:
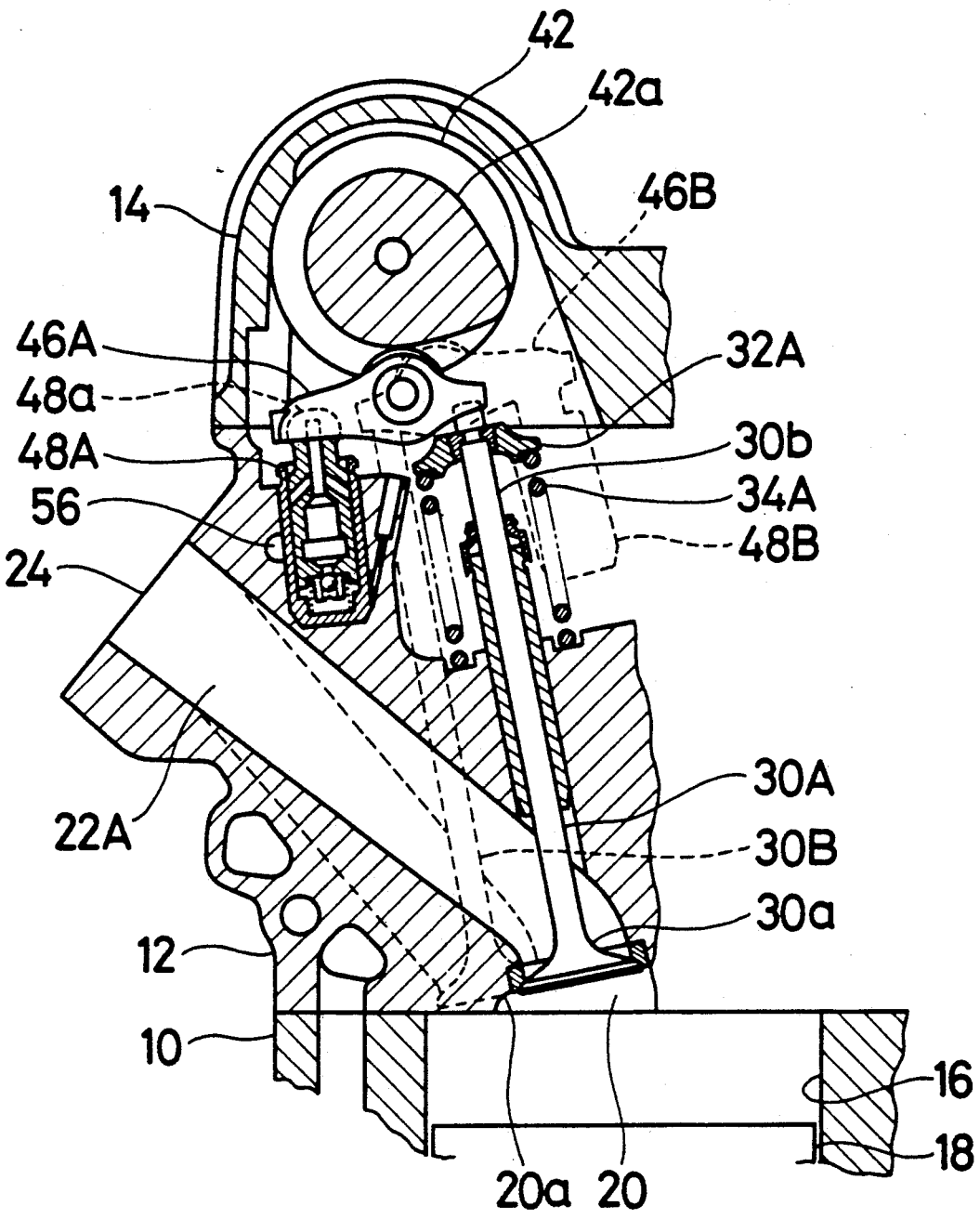
Figure 4:
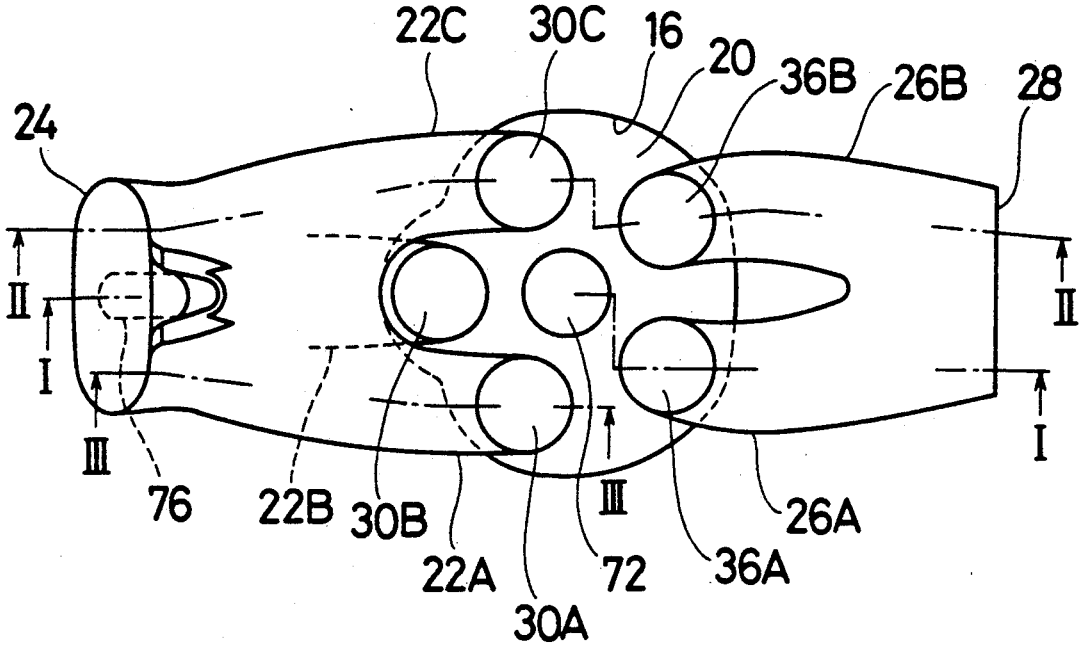

Preferred embodiments of the present invention are now described with reference to the accompanying drawings.

FIGS. 1 through 4 show a 4-cylinder, in-line, multi-valve engine having three intake valves and two exhaust valves. Although each drawing represents only one cylinder, other cylinders not shown in the drawings have the same construction as the one shown in the drawings.

Now referring to FIGS. 1 through 4, reference numeral 10 is a cylinder block, 12 is a cylinder head provided on the cylinder block 10, and 14 is a cam housing provided on the cylinder head 12. The cylinder block 10 has a cylinder 16 in which a piston 18 is slidably inserted. The cylinder head 12 includes a pent-roof shaped combustion chamber 20 having a pair of inclined walls **20*a*, 20*b***.

Three independent intake ports 24A, 24B, 24C are located on the left side of the cylinder 16 of the cylinder head 12 in order to introduce fresh air into the engine. These three independent intake ports 24A, 24B, 24C join together at an upstream end thereof to form a single intake port 24. Downstream ends of the independent intake ports 24A, 24B, 24C open at the inclined wall **20*a* on the left side of the combustion chamber 20. Openings of the independent intake ports 24A, 24C on both sides are lined in the longitudinal direction (vertical direction in FIG. 4) of the engine and also located in closer positions to the center of a bore of the cylinder 16 than an opening of the central independent intake port 24B**.

Located on the right side of the cylinder 16 of the cylinder head 12 are two independent exhaust ports 26A, 26B to guide an exhaust from the cylinder 16 to the outside. These two exhaust ports 26A, 26B join together at an downstream end thereof to form a single exhaust port 28. Upstream ends of the independent exhaust ports 26A, 26B open at the inclined wall **20*b* on the right side of the combustion chamber 20**. These two openings are lined in the longitudinal direction of the engine.

The cylinder head 12 includes a centrally-located intake valve 30B for opening or closing the opening of the independent intake port 24B, and two side-located intake valves 30A, 30C for opening or closing the openings of the independent intake ports 24A, 24C. The above-mentioned centrally-located intake valve 30B and two side-located intake valves 30A, 30C constitute a first valve group. Each intake valve 30A, 30B, 30C has a bevel-shaped valve head **30*a* disposed at each opening, and a valve stem 30*b* upwardly extending from the valve head 30*a*. These valve stems 30*b* are slidably fitted to the cylinder head 12 so as to allow a vertical motion of each intake valve 30A, 30B, 30C. In this case, these three intake valves 30A, 30B, 30C are oriented such that each valve stem 30*b* thereof is inclined toward the left side of the bore of the cylinder 16** and is arranged in parallel to each other.

Disc-type spring seats 32A, 32B, 32C are attached respectively at an end portion of each valve stem **30*b* of the intake valves 30A, 30B, 30C. Valve springs 34A, 34B, 34C are inserted between these spring seats 32A, 32B, 32C and the cylinder head 12. The valve springs 34A, 34B, 34C press each intake valve 30A, 30B, 30C** upwardly, i.e. a direction to close the valves, with the spring force thereof.

The cylinder head 12 includes two exhaust valves 36A, 36B. These two exhaust valves 36A, 36B constitute a second valve group for opening or closing the openings of the independent exhaust ports 26A, 26B respectively. These exhaust valves 36A, 36B are oriented such that each valve stem **36*b* thereof is inclined toward the right side of the bore of the cylinder 16** and is arranged in parallel to each other.

The exhaust valves 36A, 36B are movable in the vertical direction in the same construction as the intake valves 30A, 30B, 30C. Further, the exhaust valves 36A, 36B are pressed in the direction to close the valves by spring seats 38A, 38B and valve springs 40A, 40B.

A drive mechanism of the intake valves 30A, 30B, 30C and the exhaust valves 36A, 36B is now described. An intake camshaft 42 and an exhaust camshaft 44, both extending in the longitudinal direction of the engine, are mounted respectively on the left and the right side of the cam housing 14. These camshafts 42, 44 are actuated by an engine output shaft (not shown in the drawings). The intake camshaft 42 rotates in a clockwise direction of FIG. 1. The exhaust camshaft 44 rotates in an anti-clockwise direction of FIG. 1. The intake camshaft 42 includes integrally-formed three intake cams **42*a* corresponding to each intake valve 30A, 30B, 30C. The exhaust camshaft 44 includes integrally-formed two exhaust cams 44*a* corresponding to each exhaust valve 36A, 36B**.

The intake valves 30A, 30B, 30C are actuated by the intake camshaft 42 by means of rocker arms 46A, 46B, 46C. Hydraulic lash adjuster means 48A, 48B, 48C, each having a pivot **48*a* as a supporting portion, are provided on the cylinder head 12. One end of each rocker arm 46A, 46B, 46C is supported by the pivot 48*a* of each hydraulic lash adjuster means 48A, 48B, 48C, while the other end thereof is mounted on the end portion of the valve stem 30*b* of each intake valve 30A, 30B, 30C. Respectively located substantially at the center of the rocker arms 46A, 46B, 46C are rollers 46*a*, each having a rotational axis in the longitudinal direction of the engine. Each roller 46*a* makes contact with the intake cam 42***a*. Thus, when the intake camshaft 42 rotates, the rollers 46*a* initiate a vertical motion according to a lifted amount of the intake cams 42*a*. This vertical motion of the rollers 46*a* causes the rocker arms 46A, 46B, 46C to swing in the vertical direction on one ends thereof as their supporting points. Thus, the other ends of the rocker arms 46A, 46B, 46C start to swing in the vertical direction. Consequently, along with this vertical motion of the other ends, the intake valves 30A, 30B, 30C open or close each opening of the independent intake ports 24A, 24B, 24C.

The exhaust valves 36A, 36B are actuated by the exhaust camshaft 44 by means of rocker arms 50A, 50B. This drive mechanism also includes hydraulic lash adjuster means 74, 75 for supporting the rocker arms 50A, 50B, as in the case of the intake valves 30A, 30B, 30C. When the exhaust camshaft 44 rotates, the rollers 50*a* of the rocker arms 50A, 50B initiate a vertical motion according to a lifted amount of the exhaust cams 44*a*. This vertical motion of the rollers 50*a* cause the rocker arms 50A, 50B to swing in the vertical direction on one ends thereof as their supporting points. Thus, the other ends of the rocker arms 50A, 50B start to swing in the vertical direction. Consequently, along with this vertical motion of the other ends, the exhaust valves 36A, 36B open or close each opening of the independent exhaust ports 26A, 26B.

Although the three intake valves 30A, 30B, 30C constitute the first valve group and the two exhaust valves 36A, 36B constitute the second valve group in this embodiment, three exhaust valves may constitute a first valve group and two intake valves may constitute a second valve group in other embodiments.

Next, the construction of the hydraulic lash adjuster means 48A, 48B, 48C will be described with reference to FIG. 5.

Figure 5:
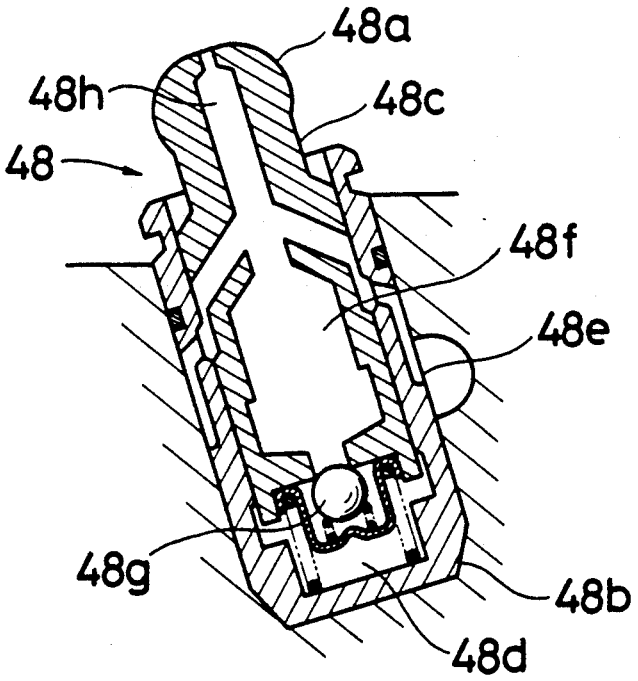

Referring to FIG. 5, reference numeral 48*b* designates a cylindrical casing having a bottom thereof, and 48*c* designates an inner sleeve slidably inserted inside the casing 48*b*. A hydraulic chamber 48*d* is formed between this casing 48*b* and the inner sleeve 48*c*. An oil passage 48*f* is provided inside the casing 48*b* and the inner sleeve 48*c*. One end of the oil passage 48*f* communicates with the hydraulic chamber 48*d* and the other end thereof communicates with an oil inlet 48*e* which is provided on an outer wall of the casing 48*b*. A check valve 48*g* is attached at one end portion of the oil passage 48*f* in order to keep a hydraulic pressure inside the hydraulic chamber 48*d* at a higher level. An oil discharge passage 48*h* is provided in the inner sleeve 48*c*. One end of this oil discharge passage 48*h* communicates with the oil passage 48*f* and the other end thereof opens at the center of the pivot 48*a* in order to relieve oil.

Now, the function of the hydraulic lash adjuster means 48A, 48B, 48C will be explained.

When each pivot 48*a* is subject to a lower supporting force respectively by the rocker arms 46A, 46B, 46C due to a lash in the valve systems, an oil pressure becomes lower in the hydraulic chamber 48*d* and this causes the check valve 48*g* to open. Along with the opening of the check valve 48*g*, oil is supplied from the oil inlet 48*e* to the hydraulic chamber 48*d* through the oil passage 48*f*. Volume expansion in the hydraulic chamber 48*d* pushes the inner sleeve 48*c* upwardly out of the casing 48*b*. As a result, a clearance between each rocker arm 46A, 46B, 46C and intake camshaft 42, and a clearance between each rocker arm 46A, 46B, 46C and intake valves 30A, 30B, 30C become zero. Thus, a higher supporting force is imposed on the pivots 48*a* by each rocker arm 46A, 46B, 46C. Consequently, an oil pressure in the hydraulic chamber 48*d* becomes higher and this causes the check valve 48*g* to close. Accordingly, the position of the inner sleeve 48*c* is fixed in the casing 48*b*, and each rocker arm 46A, 48B, 46C is supported by the pivots 48*a*.

The construction and function of the hydraulic lash adjuster means 52A, 52B are the same as the hydraulic lash adjuster means 48A, 48B, 48C. Therefore, the description thereof is omitted.

Referring now to FIGS. 1 through 4 again, a positional relation of the hydraulic lash adjuster means 48A, 48B, 48C, 52A and 52B are described.

Firstly, looking at the intake side, the first hydraulic lash adjuster means 48B for the centrally-located intake valve 30B is positioned closer to the central bore axis of the cylinder 16 than the centrally-located intake valve 30B, i.e. a delay side in the rotational direction of the intake camshaft 42. This first hydraulic lash adjuster means 48B is inclined to the left at a fixed angle toward the pivot 48*a*. In other words, the first hydraulic lash adjuster means 48B is inclined parallel to a direction of a supporting force for the rocker arm 46B.

The second and third hydraulic lash adjuster means 48A, 48C for the side-located intake valves 30A, 30C are positioned farther from the central bore axis of the cylinder 16 than the side-located intake valves 30A, 30C, i.e. a leading side in the rotational direction of the intake camshaft 42.

In this way, the second and third hydraulic lash adjuster means 48A and 48C, and the first hydraulic lash adjuster means 48B on the intake side are positioned in a zigzag configuration across the intake valves 30A, 30B, 30C in the longitudinal direction of the engine.

Secondary, looking at the exhaust side, the hydraulic lash adjuster means 52A, 52B for the exhaust valves 36A, 36B are positioned farther from the central bore axis of the cylinder 16 than the exhaust valves 36A, 36B, i.e. a leading side in the rotational direction of the exhaust camshaft 44.

The cylinder head 12 comprises: a first oil supply passage 54 communicating with the oil inlet 48*e* of the first hydraulic lash adjuster means 48B for the centrally-located intake valve 30B; a second oil passage 56 communicating with the oil inlets 48*e* of the second and third hydraulic lash adjuster means 48A, 48C for the side-located intake valves 30A, 30C; and a third oil supply passage 58 communicating with the oil inlets 48*e* of the hydraulic lash adjuster means 52A, 52B for the exhaust valves 36A, 36B.

A construction of an oil passage for supplying oil to the first through third oil supply passages 54, 56, 58 is described with reference to FIGS. 6 through 8.

Figure 6:
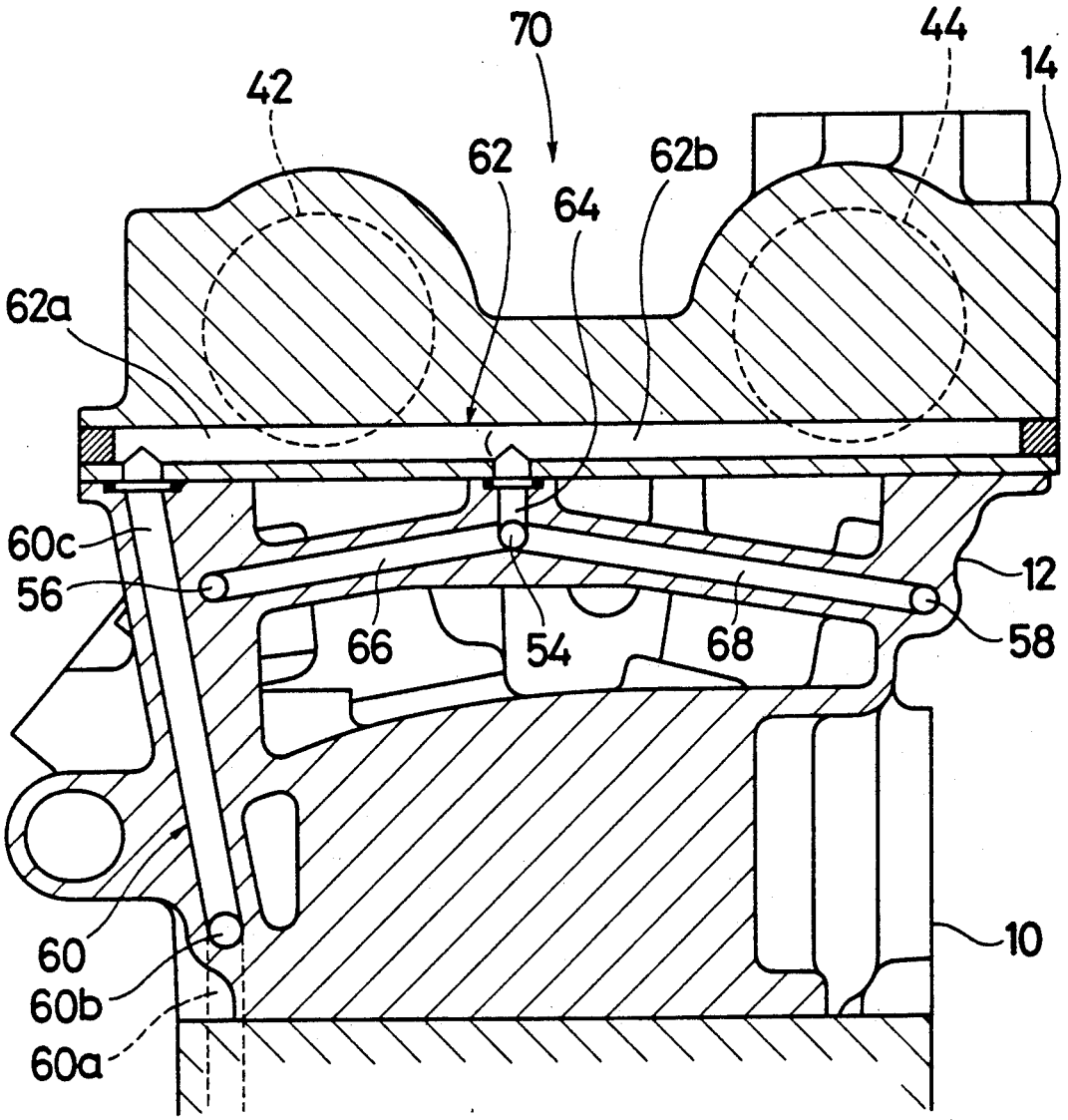
Figure 7:
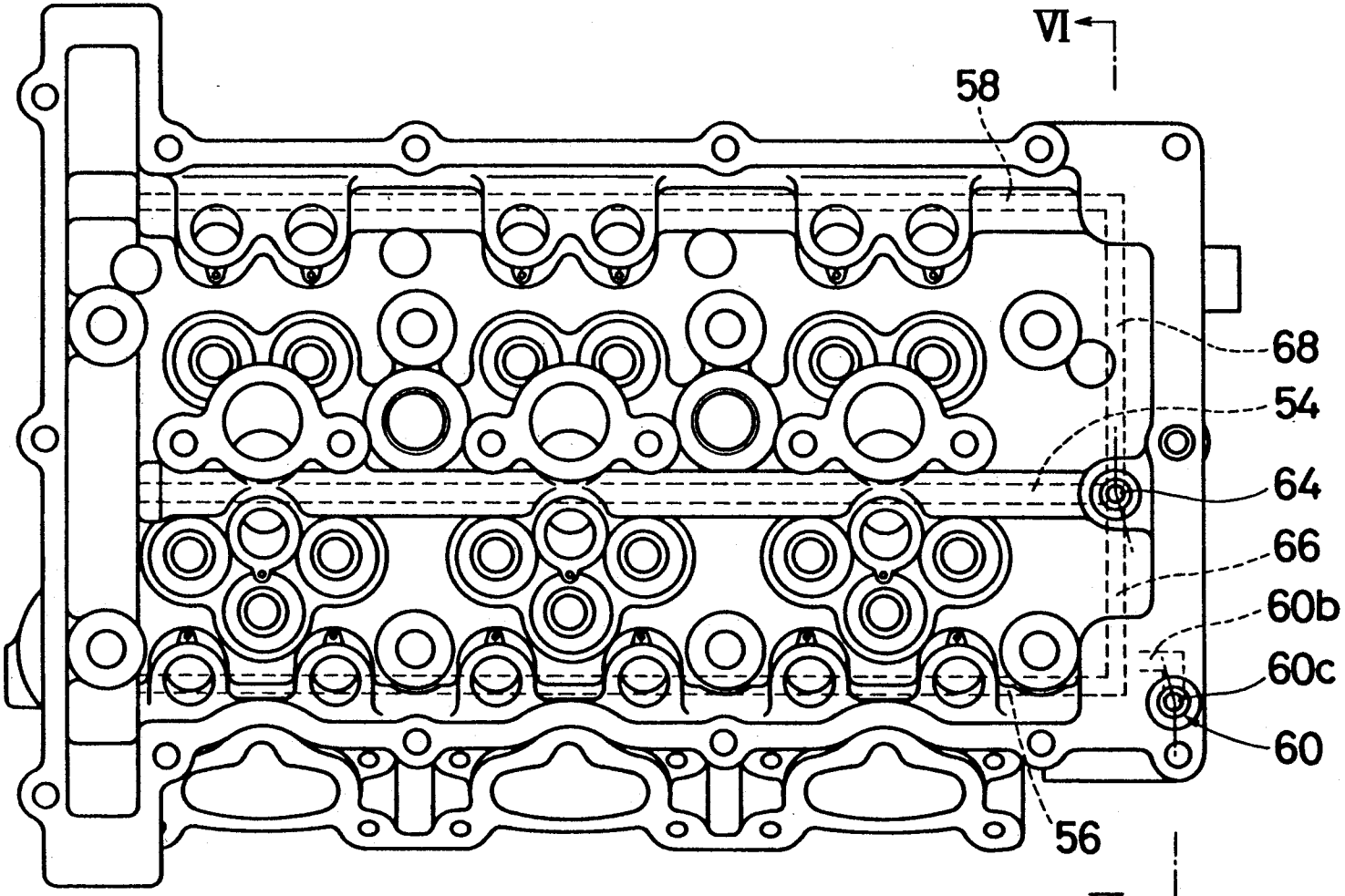
Figure 8:
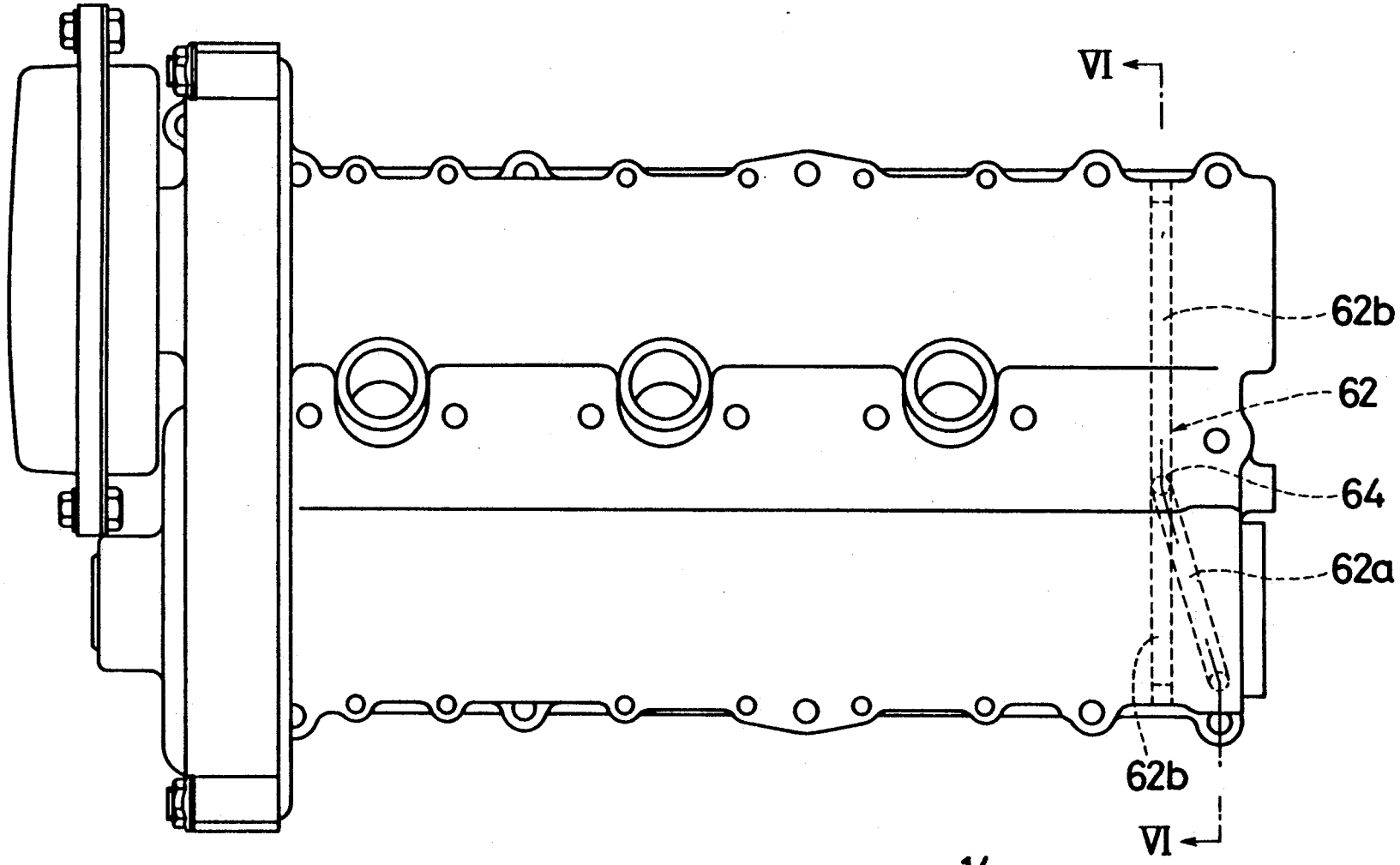

In FIGS. 6 through 8, reference numeral 60 designates a first passage. This first passage 60 comprises passage portions 60*a*, 60*b* and 60*c*. One end of the passage portion 60*a* is connected to a longitudinal center of a main oil passage (not shown in the drawings) passing through the cylinder block 10 in the longitudinal direction. The other end of the passage portion 60*a* upwardly passes through the cylinder block 10 so as to reach the inside of the cylinder head 12 as shown in FIG. 6. The passage portion 60*b* rearwardly (to the right of FIG. 6) extends inside the cylinder head 12 so as to reach the rear of the cylinder head 12. The passage portion 60*c* upwardly passes through the cylinder head 12 in the rear thereof so as to reach the inside of the cam housing 14.

A second passage 62 is connected to the first passage 60. The second passage 62 comprises passage portions 62*a*, 62*b*. One end of the passage portion 62*a* is connected to the first passage 60 inside the cam housing 14. The other end of the passage portion 62*a* diagonally extends to the upper front so as to reach a transverse center of the cam housing 14 as shown in FIG. 8. The passage portion 62*b* extends transversely from the transverse center of the cam housing 14. Left and right end portions of the passage 62*b* are connected respectively with oil passages for bearing. The oil passages for bearing are, in turn, connected to bearing collar portions (not shown in the drawings) of the intake and exhaust camshafts 42, 44.

A third passage 64 is connected to the second passage 62. One end of the third passage 64 is connected to the passage portion 62*b* of the second passage 62 inside the cam housing 14. The other end of the third passage 64 downwardly passes through the cam housing 14 so as to reach the inside of the cylinder head 12, and then is connected to the first oil supply passage 54. A left branch passage 66 and a right branch passage 68 are connected to this third passage 64A. The left and right branch passages 66, 68 are, in turn, connected respectively to the second and third oil supply passages 56, 58.

With the above-mentioned construction, a highly-pressurised oil which is pressurised by an oil pump (not shown in the drawings) of the engine and is supplied to the main oil passage is then supplied to the third passage 64 through the first passage 60 and the second passage 62. The oil supplied to this third passage 64 is next sent to the first oil supply passage 54. Finally, the oil is supplied from this first oil supply passage 54 to the first hydraulic lash adjuster means 48B for the centrally-located intake valve 30B.

The remaining oil in the third passage 64 is supplied to the second and the third oil supply passages 56, 58 through the left and right branch passages 66, 68. Then, the oil are sent from the second and third oil supply passages 56, 58 respectively to the second and third hydraulic lash adjuster means 48A, 48C for the side-located intake valves 30A, 30C and the hydraulic lash adjuster means 52A, 52B for the exhaust valves 36A, 36B. A part of the oil supplied to the second passage 62 is sent to bearing collar portions for the intake and exhaust camshafts 42, 44 through the oil supply passage for bearing.

Above-mentioned first to third passages 60, 62, 64, the left and right branch passages 66, 68 and the first to third oil supply passages 54, 56, 58 constitute an oil passage 70 which supplies the oil in the main oil passage to the first hydraulic lash adjuster means 48B for the centrally-located intake valve 30B, and then to the second and third hydraulic lash adjuster means 48A, 48C for the side-located intake valves 30A, 30C.

A plug hole 72 passes through the cylinder head 12 and the cam housing 14 in the upper part of the combustion chamber 20. An ignition plug 74 is provided in this plug hole 72 in such a way that an ignition point 74*a* of this ignition plug 74 faces the inside of the combustion chamber 20. The plug hole 72 and the ignition plug 74 are arranged in parallel to the valve stems 36*b* each for the exhaust valves 36A, 36B so that the ignition point 74*a* is located at the bore center of the cylinder 16 inside the combustion chamber 20. An injector 76 is provided at the cylinder head 12 in the upper part of the intake port in order to inject fuel into an introduced fresh air.

The three rocker arms 46A, 46B, 46C are made of the same type of members. In this case, one can easily come up with the idea of matching the centers of the rollers 46*a* for the three rocker arms 46A, 46B, 46C. However, in this embodiment, this idea has not been adopted in order to avoid larger-sized rocker arms 46A, 46B, 46C.

According to the above-mentioned detailed description of the preferred embodiments, the intake valves 30A, 30B, 30C are oriented such that each valve stem 30*b* thereof is inclined outwardly to the left side of the bore of the cylinder 16. Meanwhile, the exhaust valves 36A, 36B are oriented such that each valve stem 36*b* thereof is inclined outwardly to the right side of the bore of the cylinder 16. Thus, the lower surfaces of the valve heads 30*a*, 36*a* of the intake and exhaust valves can be formed into an angular shape, thereby forming an efficient pent-roof type combustion chamber 20.

The intake valves 30A, 30B, 30C are disposed so as to arrange the valve stems 30*b* thereof in parallel to each other. Further, the exhaust valves 36A, 36B, too, are disposed so as to arrange the valve stems 36*b* thereof in parallel to each other. Accordingly, both inclined walls 20*a*, 20*b* of the combustion chamber 20 are formed into a single uninterrupted plane. In this way, since the combustion chamber 20 can be formed into a favorable shape, a quench area will never be formed and generation of HC etc. will be restricted, thereby improving an emission performance of the engine.

In this embodiment, the first hydraulic lash adjuster means 48A, 48B, 48C for the intake valves 30A, 30B, 30C are provided in a zigzag configuration. Accordingly, the rocker arm 46B and the first hydraulic lash adjuster means 48B for the centrally-located intake valve 30B can be arranged in a position closer to the bore center of the cylinder 16 than the centrally-located intake valve 30B. In contrast, the rocker arms 46A, 46C and the second and third hydraulic lash adjuster means 48A, 48C for the side-located intake valves 30A, 30C are arranged in positions farther from the bore center of the cylinder 16 than the side-located intake valves 30A, 30C. This positional relation allows smaller longitudinal length of the engine, thus realizing a compact engine.

Figure 9:
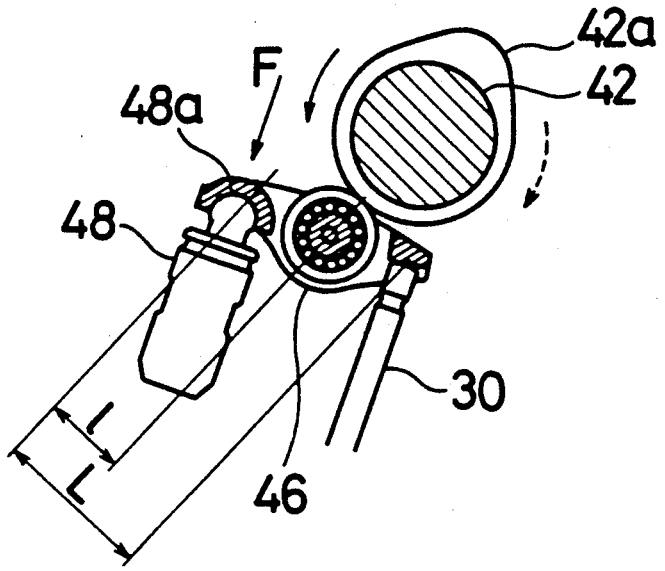
FIG. 9 is an explanatory drawing of a supporting force.

Referring now to FIG. 9, a transmission of power acting on the rocker arm 46 on the intake side will be described.

A contact force of the cam 42*a* acts on the rocker arm 46. Then, this contact force is divided into a force acting on an end portion of the valve stem 30*b* of the intake valve 30 and a force acting on the supporting portion 48*a* of the hydraulic lash adjuster means 48, i.e. a supporting force F. When taking a lever ratio R into consideration (this lever ratio R is to show at what times of stroke amount the intake valve 30 moves compared with the lifted amount of the cam 42*a*), the supporting force F increase as this lever ratio R increases in the case where the contact force of the cam 42*a* remains consistent. More specifically, this lever ratio R can be determined by the equation: $R=L/l$ Namely, R is determined by dividing L (= a distance between a contact point of the rocker arm 46 with the supporting portion 48*a* and a contact point of the rocker arm 46 with the end portion of the valve stem 30*b*) by l (= a distance between a contact point of the rocker arm 46 with the supporting portion 48*a* and a contact point of the rocker arm 46 with the cam 42*a*).

Figure 10:
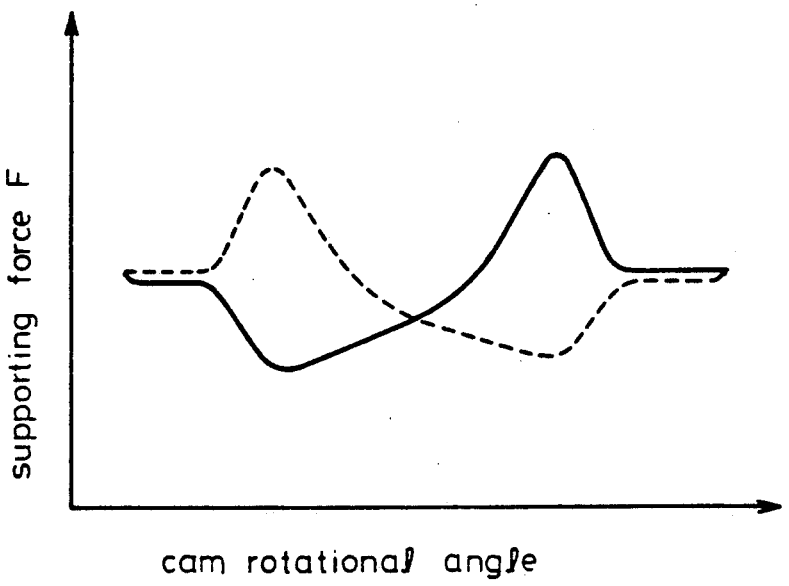
FIG. 10 is a diagram based on a test result, illustrating a variation in the supporting force.

Comparison is made between the case when a rotational direction of the cam 42*a* is set in a direction indicated by a continuous line (in this case, the hydraulic lash adjuster means 48 is disposed on the delay side of the rotational direction of the camshaft 42) and the case when a rotational direction of the cam 42*a* is set in a direction indicated by a broken line (in this case, the hydraulic lash adjuster means 48 is disposed on the leading side of the rotational direction of the camshaft 42). The result of the comparison is shown in FIG. 10. The difference in the rotational direction of the cam 42*a* results in the difference in the variation of the lever ratio R between the above two cases. FIG. 10 illustrates that when the hydraulic lash adjuster means 48 is arranged on the leading side (the broken line) of the rotational direction of the camshaft 42, a maximum value of the supporting force F becomes smaller than the case when the hydraulic lash adjuster means 48 is arranged on the delay side (the continuous line) of the rotational direction of the camshaft 42, and further the maximum point of the supporting force F can be set on the opening side of the intake valve 30.

In this embodiment, as described earlier, the second and third hydraulic lash adjuster means 48A, 48C for the side-located intake valves 30A, 30C are disposed on the leading side of the rotational direction of the intake camshaft 42. As a result, a lever ratio R of the rocker arms 46A, 46C becomes smaller, thus restricting the supporting force for the second and third hydraulic lash adjuster means 48A, 48C. Accordingly, durability and reliability of the second and third hydraulic lash adjuster means 48A, 48C can be increased and a higher rotational limit of the engine can be achieved. In addition, since the maximum point of the supporting force F is set on the opening side of the valve, jumping phenomena of the side-located intake valves 30A, 30C upon closing can be prevented, thus accurately maintaining a timing for finishing the intake operation throughout the whole range of the engine rotation.

The first hydraulic lash adjuster means 48B for the centrally-located intake valve 30B is arranged on the delay side of the rotational direction of the camshaft 42. However, a lateral force will not act on the inner sleeve 48*c* of the first hydraulic lash adjuster means 48B since the first hydraulic lash adjuster means 48B is inclined from the central line of the bore of the cylinder 16 at a fixed angle to be parallel to a direction of the supporting force. As a result, the inner sleeve 48*c* reciprocatingly moves smoothly without any vibration including pivotal swing movement thereof. Thus, the inner sleeve 48*c* is free from an excessive wear on the sliding contact surface thereof. Consequently, durability and reliability of the first hydraulic lash adjuster means 48B can be improved and the rotational limit of the engine can be increased.

Since the first hydraulic lash adjuster means 48B for the centrally-located intake valve 30B is disposed on the delay side of the rotational direction of the camshaft 42, the supporting force F increases. However, the first oil supply passage 54 of the independent oil passage supplies oil from the main oil passage, firstly, to this first hydraulic lash adjuster means 48B before other second and third hydraulic lash adjuster means 48A, 48C. Consequently, a stable oil pressure acts on the first hydraulic lash adjuster means 48B, thereby allowing a smooth reciprocating motion of the inner sleeve 48*c*. In this way, durability and reliability of the first hydraulic lash adjuster means 48B can be further improved.

In the engine of the present embodiment, although the first hydraulic lash adjuster means 48B is inclinedly provided, the plug hole 72 is inclinedly disposed to be parallel to the exhaust valves 36A, 36B in order to avoid the interference with the first hydraulic lash adjuster means 48B. Thus, the compactness of the engine can be maintained.

The ignition point 74*a* of the ignition plug 74 is located at the bore center of the cylinder 16 in the combustion chamber 20 in the engine in accordance with the present embodiment. Accordingly, flame propagation in the radial direction of the bore of the cylinder 16 can be consistent. As a result, maximum advantage of the pent-roof type combustion chamber 20, i.e. an improved combustion efficiency, can be reliably obtained.

What is claimed is:

1. A multi-valve engine of the type having a line of cylinders, intake and exhaust camshafts, and rocker arms for operatively connecting valves to said camshafts, comprising:

a first valve group having a centrally-located valve and two side-located valves consisting of either intake valves actuated by said intake camshaft through said rocker arms, or exhaust valves actuated by said exhaust camshaft through said rocker arms;

a second valve group consisting of the other of either said intake valves or said exhaust valves;

wherein each of said valves of said first valve group is oriented such that a valve stem thereof is inclined outwardly to one side of said line of cylinders, and each of said valves of said second valve group is oriented such that a valve stem thereof is inclined outwardly to an opposite side of said line of cylinders;

first hydraulic lash adjuster means for supporting a first one of said rocker arms actuating said centrally-located valve, said first lash adjuster means being positioned closer to a central bore axis of an associated one of said cylinders than said centrally-located valve, such that said first lash adjuster means is inclined parallel to a direction of a supporting force for said first rocker arm; and second and third hydraulic lash adjuster means for supporting second and third ones of said rocker arms actuating said side-located valves, said second and third lash adjuster means being positioned farther from said central bore axis than said side-located valves.

2. A multi-valve engine of the type having a line of cylinders, intake and exhaust camshafts, and rocker arms for operatively connecting valves to said camshafts, comprising:

a first valve group having a centrally-located valve and two side-located valves consisting of either intake valves actuated by said intake camshaft through said rocker arms, or exhaust valves actuated by said exhaust camshaft through said rocker arms;

a second valve group consisting of the other of either said intake valves or said exhaust valves;

said centrally-located valve and side-located valves of said first valve group are biased away from each other in a direction forming a right angle with said line of cylinders;

first hydraulic lash adjuster means for supporting a first one of said rocker arms actuating said centrally-located valve is on a delay side of said centrally-located valve in a rotational direction of a camshaft for driving said first valve group; and second and third hydraulic lash adjuster means for supporting second and third ones of said rocker arms actuating said side-located valves are on a leading side of said side-located valves in said rotational direction of said camshaft.

3. A multi-valve engine as defined in claim 2 wherein said centrally-located valve is inclined parallel to a direction of a supporting force acting on said first rocker arm from said first hydraulic lash adjuster means which supports said first rocker arm actuating said centrally-located valve.

4. A multi-valve engine as defined in claim 2 further comprising an oil passage for supplying oil from a main oil passage, first to said first hydraulic lash adjuster means for said centrally-located valve, and then to said second and third hydraulic lash adjuster means for said side-located valves.

5. A multi-valve engine as defined in claim 1 wherein said first valve group is comprised of three intake valves and said second valve group is comprised of two exhaust valves.

6. A multi-valve engine as defined in claim 5 wherein said exhaust valves of said second valve group are arranged in parallel to each other, and wherein an ignition plug is provided in parallel to each of said exhaust valves.

7. A multi-valve engine as defined in claim 6 wherein an ignition point of said ignition plug is located at said bore center of said cylinder in a combustion chamber.

8. A multi-valve engine as defined in claim 5 wherein said intake valves of said first valve group are arranged in parallel to each other, and wherein said exhaust valves comprising said second valve group are arranged in parallel to each other.

9. A multi-valve engine as defined in claim 4 wherein a first oil supply passage for supplying oil to said first hydraulic lash adjuster means for said centrally-located valve is connected directly to said main oil passage, a second oil supply passage for supplying oil to said second and third hydraulic lash adjuster means for said side-located valves and a third oil supply passage for supplying oil to hydraulic lash adjuster means for valves of said second valve group are connected respectively to said main oil passage through branch passages which are branched off from the connecting point between said main oil passage and said first oil supply passage.

10. A multi-valve engine as defined in claim 8 further comprising an ignition plug disposed in parallel to each of said exhaust valves.

11. A multi-valve engine as defined in claim 10 wherein an ignition point of said ignition plug is located at said bore center of said cylinder in a combustion chamber.

12. A multi-valve engine as defined in claim 3 further comprising an oil passage for supplying oil from a main oil passage first to said first hydraulic lash adjuster means for said centrally-located valve, and then to said second and third hydraulic lash adjuster means for said side-located valves.

13. A multi-valve engine as defined in claim 12 wherein a first oil supply passage for supplying oil to said first hydraulic lash adjuster means for said centrally-located valve is connected directly to said main oil passage, a second oil supply passage for supplying oil to said second and third hydraulic lash adjuster means for said side-located valves and a third oil supply passage for supplying oil to hydraulic lash adjuster means for valves of said second valve group are connected respectively to said main oil passage through branch passages which are branched off from the connecting point between said main oil passage and said first oil supply passage.

14. A multi-valve engine as defined in claim 2 wherein said first valve group consists of three intake valves, and said second valve group consists of two exhaust valves.

15. A multi-valve engine as defined in claim 3 wherein said first valve group consists of three intake valves, and said second valve group consists of two exhaust valves.

16. A multi-valve engine as defined in claim 4 wherein said first valve group consists of three intake valves, and said second valve group consists of two exhaust valves.

17. A multi-valve engine as defined in claim 9 wherein said first valve group consists of three intake valves, and said second valve group consists of two exhaust valves.

18. A multi-valve engine as defined in claim 12 wherein said first valve group consists of three intake valves, and said second valve group consists of two exhaust valves.

19. A multi-valve engine as defined in claim 15 wherein said exhaust valves of said second valve group are provided in parallel to each other, and wherein an ignition plug is provided in parallel to each of said exhaust valves.

20. A multi-valve engine as defined in claim 19 wherein an ignition point of said ignition plug is located at a bore center of said cylinder in a combustion chamber.

* * * * *